US009647385B2

(12) United States Patent
Suh

(10) Patent No.: US 9,647,385 B2
(45) Date of Patent: May 9, 2017

(54) MAGNETIC CONNECTION DEVICE

(71) Applicant: SAMSUNG ELECTRONICS CO., LTD., Suwon-si (KR)

(72) Inventor: Hwan-soo Suh, Gunpo-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/220,757

(22) Filed: Mar. 20, 2014

(65) Prior Publication Data

US 2014/0287601 A1 Sep. 25, 2014

(30) Foreign Application Priority Data

Mar. 22, 2013 (KR) ..... 10-2013-0030986

(51) Int. Cl.
*H01R 13/62* (2006.01)
*H01R 11/30* (2006.01)

(52) U.S. Cl.
CPC ..... *H01R 13/6205* (2013.01); *H01R 11/30* (2013.01)

(58) Field of Classification Search
USPC ..... 439/39, 38; 362/249.6; 336/90
See application file for complete search history.

(56) References Cited

U.S. PATENT DOCUMENTS

| | | | | |
|---|---|---|---|---|
| 6,030,229 | A * | 2/2000 | Tsutsui | 439/39 |
| 7,351,066 | B2 * | 4/2008 | DiFonzo et al. | 439/39 |
| 7,517,222 | B2 * | 4/2009 | Rohrbach et al. | 439/39 |
| 7,637,746 | B2 * | 12/2009 | Lindberg et al. | 439/38 |
| 7,722,358 | B2 * | 5/2010 | Chatterjee et al. | 439/38 |
| 8,187,006 | B2 * | 5/2012 | Rudisill et al. | 439/39 |
| 2006/0051981 | A1 * | 3/2006 | Neidlein et al. | 439/39 |
| 2007/0177298 | A1 * | 8/2007 | Jaatinen et al. | 360/123 |
| 2008/0164934 | A1 * | 7/2008 | Hankey et al. | 327/407 |
| 2012/0282786 | A1 * | 11/2012 | Neel | 439/39 |
| 2013/0273752 | A1 * | 10/2013 | Rudisill et al. | 439/39 |
| 2013/0323941 | A1 * | 12/2013 | Zeliff et al. | 439/39 |
| 2014/0162468 | A1 * | 6/2014 | Kim | 439/39 |
| 2014/0287601 | A1 * | 9/2014 | Suh | 439/39 |
| 2014/0322929 | A1 * | 10/2014 | Asai et al. | 439/39 |
| 2015/0024611 | A1 * | 1/2015 | Wilkolaski et al. | 439/39 |

FOREIGN PATENT DOCUMENTS

KR 10-1171070 B1 8/2012

* cited by examiner

*Primary Examiner* — Alexander Gilman
(74) *Attorney, Agent, or Firm* — Sughrue Mion, PLLC

(57) ABSTRACT

A magnetic connection device including a first connector including a first housing and a plurality of first electrodes mounted on the first housing in a state of being partially exposed and having magnetic substances; and a second connector including a second housing, a plurality of second electrodes mounted on the second housing and having magnetic substances, and elastic members for elastically supporting the plurality of second electrodes, wherein an end portion of each of the plurality of second electrodes is located in the second housing due to an elasticity of the elastic members in a state where a magnetic attraction is not applied from the plurality of first electrodes, and protrudes out of the second housing to be electrically connected to each of the plurality of first electrodes when there is the magnetic attraction applied from the plurality of first electrodes.

20 Claims, 10 Drawing Sheets

MAGNETIC CONNECTION DEVICE

CROSS-REFERENCE TO RELATED APPLICATIONS

This application claims the benefit of Korean Patent Application No. 10-2013-0030986, filed on Mar. 22, 2013 in the Korean Intellectual Property Office, the disclosure of which is incorporated herein in their entirety by reference.

BACKGROUND

1. Field

The present disclosure relates to connection devices, and more particularly, to magnetic connection devices electrically connecting by using magnetic property.

2. Description of the Related Art

In order to transmit electric signals or electric power between different electronic devices, electric wires need to be connected to be electrically connected to each other. If the connection between different electronic devices does not last permanently, electric wires need to be easily detached, and to do this, various electric connection devices are used.

A conventional connect device forms an electric connection between a female connector terminal and a male connector terminal by fitting a pin into a receiving portion or contacting electrode using elasticity of a spring, and then, mechanically fix the female connector terminal and the male connector terminal to each other.

Such a conventional connection device has an electrode in a male connector terminal of a protrusion type for electrically connecting to a female connector terminal, and such a protruding electrode may be damaged during usage, and further, may act as a limitation in designing the electronic devices. Also, in such a connection device, a coupling strength and an electric connection characteristic are determined by fitting characteristic and elasticity between corresponding elements in the female connector terminal and the male connector terminal, and thus, considerably large force is necessary to insert and draw. Also, the connection device may be damaged if connecting directions of two connection devices do not match. In addition, noise may generate or contact may not occur due to defective coupling caused by mechanical and electrical characteristics of contact portions.

SUMMARY

Provided are magnetic connection devices making electrical connections using magnetism.

Additional aspects will be set forth in part in the description which follows and, in part, will be apparent from the description, or may be learned by practice of exemplary embodiments.

According to an aspect of an exemplary embodiment, a magnetic connection device includes: a first connector comprising a first housing and a plurality of first electrodes mounted on the first housing in a state of being partially exposed and having magnetic substances; and a second connector comprising a second housing, a plurality of second electrodes mounted on the second housing and having magnetic substances, and elastic members for elastically supporting the plurality of second electrodes, wherein an end portion of each of the plurality of second electrodes is located in the second housing due to an elasticity of the elastic members in a state where a magnetic attraction is not applied from the plurality of first electrodes, and protrudes out of the second housing to be electrically connected to each of the plurality of first electrodes when there is the magnetic attraction applied from the plurality of first electrodes.

The first connector and the second connector may be coupled to each other due to the magnetic attraction between the first electrodes and the second electrodes.

The first connector and the second connector may further include a first magnetic coupling portion and a second magnetic coupling portion, respectively.

Exposed parts of the first electrodes may be concaved from an outer surface of the first housing.

The first connector and the second connector may respectively include a first guide member and a second guide member having complementary shapes for guiding coupling positions of the first and second connectors.

Arrangements of the plurality of first electrodes and the plurality of second electrodes may be symmetric with each other with respect to at least two positions where the first connector and the second connector are coupled to each other.

The plurality of first electrodes may be arranged in a first magnetic arrangement and the plurality of second electrodes may be arranged in a second magnetic arrangement, and the first magnetic arrangement and the second magnetic arrangement may be arranged in arrangement orders by which all of the plurality of first electrodes and all of the plurality of second electrodes are electrically connected to each other due to the magnetic attraction when contacting each other at a first position.

A magnetic repulsive force may be applied or the magnetic attraction may not be applied to at least one of corresponding pairs of the plurality of first electrodes and the plurality of second electrodes such that the at least one of corresponding pairs of the plurality of first electrodes and the plurality of second electrodes is not electrically connected to each other when the plurality of first electrodes and the plurality of second electrodes contact each other at a second position that is different from the first position.

The plurality of first electrodes and the plurality of second electrodes may be electrically connected to each other due to the magnetic attraction even when the plurality of first electrodes and the plurality of second electrodes contact each other at a second position that is different from the first position.

When the plurality of first electrodes and the plurality of second electrodes contact each other at a first position, corresponding pairs of the plurality of first electrodes and the plurality of second electrodes may be pairs of a ferromagnetic property and a paramagnetic property, or pairs of ferromagnetic properties of opposite polarities.

When the plurality of first electrodes and the plurality of second electrodes contact each other at a second position that is different from the first position, at least one of the corresponding pairs of the plurality of first electrodes and the plurality of second electrodes may have paramagnetic properties, or ferromagnetic properties of the same polarity. When the plurality of first electrodes and the plurality of second electrodes contact each other at a second position that is different from the first position, corresponding pairs of the plurality of first electrodes and the plurality of second electrodes may be pairs of a ferromagnetic property and a paramagnetic property, or pairs of ferromagnetic properties of opposite polarities.

The magnetic connection device may further include a signal processor that readjusts signal transfer paths of the plurality of first electrodes in the first connector according to a coupling direction between the first connector and the second connector.

The signal processor may determine the coupling direction between the first connector and the second connector according to whether at least one of the corresponding pairs of the plurality of first electrodes and the plurality of second electrodes is electrically connected or not.

The plurality of first electrodes may be arranged in a first magnetic arrangement and the plurality of second electrodes may be arranged in a second magnetic arrangement, and the first magnetic arrangement and the second magnetic arrangement may allow the plurality of first electrodes and the plurality of second electrodes are electrically connected to each other due to the magnetic attraction when the plurality of first electrodes and the plurality of second electrodes contact each other at a first position, and allow at least one of corresponding pairs of the plurality of first electrodes and the plurality of second electrodes is not electrically connected because the magnetic repulsive force is applied to the pair or the magnetic attraction is not applied to the pair when the plurality of first electrodes and the plurality of second electrodes contact each other at a second position that is different from the first position.

The first connector may include a first terminal, in which the plurality of first electrodes are located, contacting the second connector, and a second terminal attached to/detached from a third connector, and the second connector may include a first terminal, in which the plurality of second electrodes are located, contacting the first connector, and a second terminal attached to/detached from a fourth connector.

The second terminal of the first connector and the second terminal of the second connector may be respectively a female connector terminal and a male connector terminal of the same type. The second terminal of the first connector and the second terminal of the second connector may be connector terminals of different types.

The second terminal of the first connector and the second terminal of the second connector may satisfy at least one of USB (Universal Serial Bus) standard, IEEE 1394 standard, D-SUB standard, DIV (Digital Video Interface) standard, and HDMI (High Definition Multimedia Interface) standard.

According to another aspect of an exemplary embodiment, a connector connected to another connector including a plurality of another electrodes having magnetic properties, the connector includes: a housing; a plurality of electrodes mounted in the housing and having magnetic properties; an elastic member elastically supporting the plurality of electrodes; wherein an end portion of each of the plurality of electrodes is located in the housing due to an elasticity of the elastic member in a state where a magnetic attraction is not applied from the plurality of another electrodes, and protrudes out of the housing to be electrically connected to each of the plurality of another electrodes when there is the magnetic attraction applied from the plurality of another electrodes.

The connector may include a first terminal, in which the plurality of electrodes are located, contacting the other connector, and a second terminal attached to/detached from the other connector and located at different location from the first terminal.

BRIEF DESCRIPTION OF THE DRAWINGS

These and/or other aspects will become apparent and more readily appreciated from the following description of one or more exemplary embodiments, taken in conjunction with the accompanying drawings of which.

DETAILED DESCRIPTION

Figure 1:
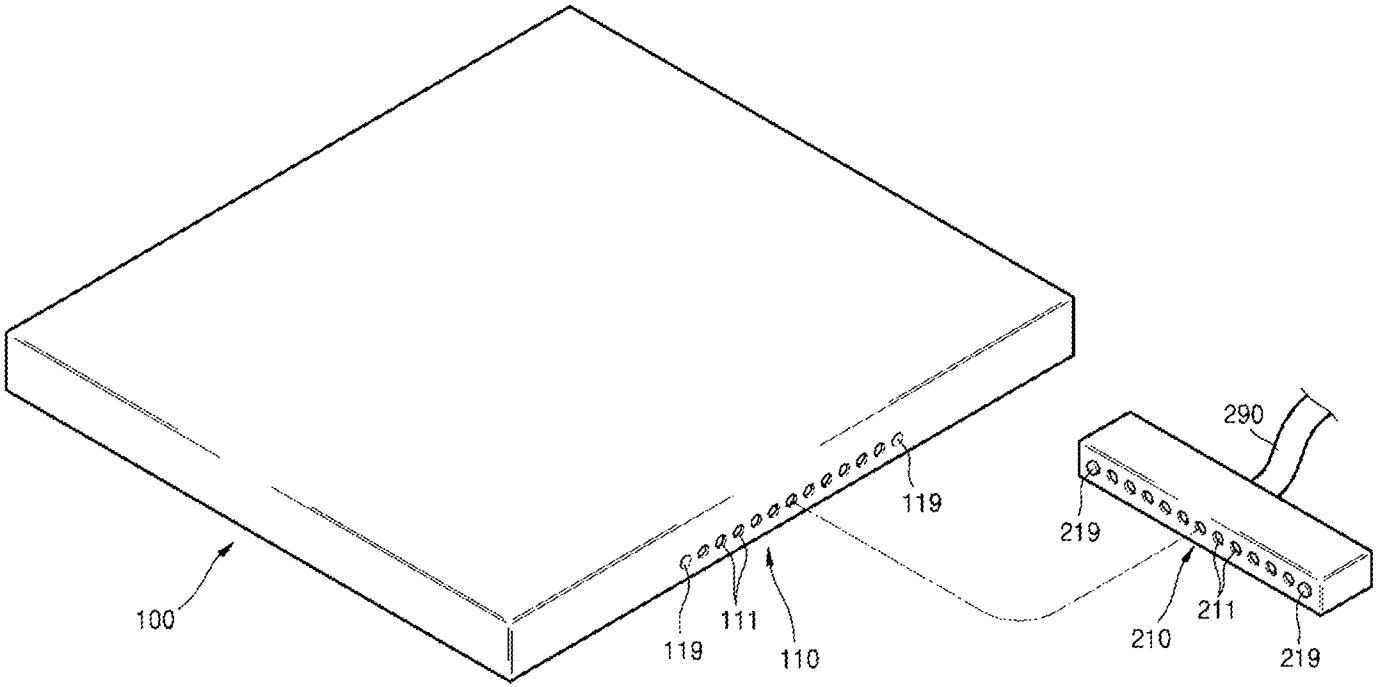
FIG. 1 is a diagram showing a magnetic connection device according to an exemplary embodiment.

Reference will now be made in detail to exemplary embodiments, examples of which are illustrated in the accompanying drawings, wherein like reference numerals refer to the like elements throughout. In this regard, the exemplary embodiments may have different forms and should not be construed as being limited to the descriptions set forth herein. Accordingly, the exemplary embodiments are merely described below, by referring to the figures, to explain aspects of the present description. Expressions such as "at least one of," when preceding a list of elements, modify the entire list of elements and do not modify the individual elements of the list.

Figure 2:
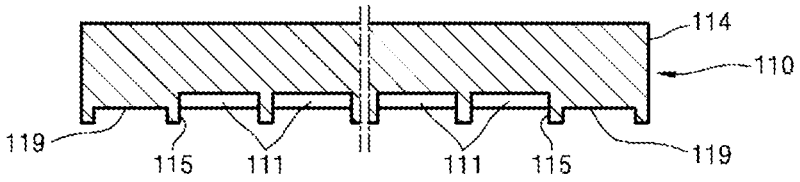
FIG. 2 is a cross-sectional view of a first connector in the magnetic connection device of FIG. 1.
Figure 3:
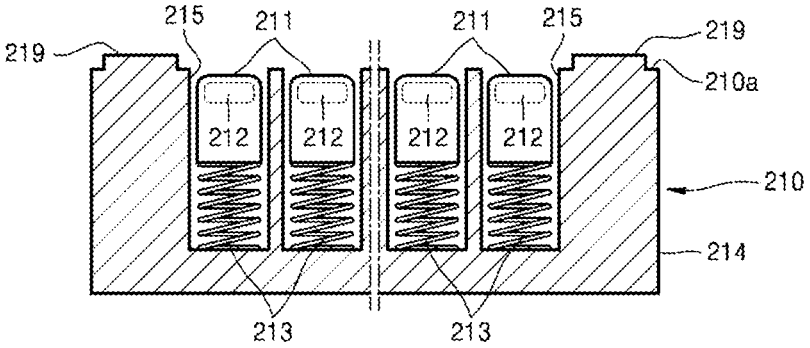
FIG. 3 is a cross-sectional view of a second connector in the magnetic connection device of FIG. 1.

FIG. 1 is a diagram showing a magnetic connection device according to an exemplary embodiment, FIG. 2 is a cross-sectional view of a first connector 110 of the magnetic connection device shown in FIG. 1, and FIG. 3 is a cross-sectional view of a second connector 210 of the magnetic connection device shown in FIG. 1. FIGS. 2 and 3 only show four first and second electrodes 111 and 211 from among a plurality of first and second electrodes 111 and 211 for convenience of description.

Referring to FIG. 1, the magnetic connection device includes the first connector 110 and the second connector 210. The first connector 110 may be provided, for example, in an electronic device 100, and the second connector 210 may be connected to another electronic device (not shown) via a cable 290.

Referring to FIG. 2, the first connector 110 includes a plurality of first electrodes 111. The first electrodes 111 are formed of a conductive material such as metal. Also, the first electrodes 111 may include ferromagnetic or paramagnetic substances, or may be formed of ferromagnetic or paramagnetic substances to show ferromagnetic or paramagnetic characteristics.

The first electrodes 111 are mounted in a first housing 114, and electric contact surfaces of the first electrodes 111 are exposed to outside of the first housing 114. The electric contact surfaces of the first electrodes 111 are located on a concave portion 115 of the first housing 114 so as to prevent the first electrodes 111 from being damaged when the first connector 110 is not connected to anything.

Referring to FIG. 3, the second connector 210 includes a plurality of second electrodes 211. The second electrodes 211 are formed of a conductive material such as metal. Also, the second electrodes 211 include ferromagnetic or paramagnetic substances. If necessary, the second electrodes 211 themselves may be formed of ferromagnetic or paramagnetic substances.

Magnetic arrangements of the first and second electrodes 111 and 211 may have an order by which magnetic attractive forces are applied to opposite pairs of the first electrodes 111 and the second electrodes 211 when the first connector 110 and the second connector 210 are connected to each other at right coupling location. If the first connector 110 and the second connector 210 are connected to each other at right coupling location, the magnet arrangements of the first electrodes 111 of the first connector 110 and the second electrodes 211 of the second connector 210 are made so that one of the opposite pairs of the first and second electrodes 111 and 211 is ferromagnetic and the other is paramagnetic, or the opposite pairs may be ferromagnetic of different polarities. As an example, the first electrodes 111 may be paramagnetic, and the second electrodes 211 may be ferromagnetic.

Due to the magnetic attraction between the first electrodes 111 and the second electrodes 211, the first electrodes 111 and the second electrodes 211 are electrically connected to each other, and moreover, the first connector 110 and the second connector 210 are coupled to each other.

The second electrodes 211 are mounted on a recess portion 215 of a second housing 214 in a state of being supported by elastic members 213 independently. The elastic members 213 may be springs as shown in FIG. 3, and the present inventive concept is not limited thereto.

The elastic members 213 provide the second electrodes 211 with a tensile force for pulling the second electrodes 211 into the recess portion 215 of the second housing 214. The elastic members 213 have the tensile force that is less than the magnetic attraction applied between the first electrodes 111 and the second electrodes 211. That is, an end of each second electrode 211 is located inside the second housing 214 due to the tensile force of the elastic member 213 in a state where the magnetic attraction is not applied, and when the magnetic attraction is applied to the second electrode 211, the end of the each second electrode 211 protrudes out of the second housing 214 to be electrically connected to each of the first electrodes 111 of the first connector 110.

The first and second electrodes 111 and 211 may be arranged symmetric with each other with respect to coupling positions of the first and second connector 110 and 210. For example, as shown in FIG. 1, the arrangements of the first and second electrodes 111 and 211 at constant intervals may be considered to deal with a case where the second connector 210 is reversed with respect to the first connector 110. Moreover, magnetism of the first and second electrodes 111 and 211 may be symmetrically arranged. If the first electrodes 111 all have the paramagnetic properties and the second electrodes 211 have the ferromagnetic properties, it may be considered as the symmetric magnetic arrangement to deal with a case where the second connector 210 is reversed with respect to the first connector 110. As described above, if the first and second electrodes 111 and 211 are arranged symmetric with each other and the magnetism of the first and second electrodes 111 and 211 is symmetrically arranged, the first electrodes 111 and the second electrodes 211 may be electrically connected to each other due to magnetic attraction even when left and right sides of the second connector 210 are reversed with respect to those of the first connector 110.

The first and second connectors 110 and 210 may respectively further include a first guide member 119 and a second guide member 219 that guide coupling locations to each other. The first and second guide members 119 and 219 may have complementary shapes that are engaged with each other, for example, concave shape and convex shape. The first and second guide members 119 and 219 are disposed symmetrically at opposite ends of the first and second electrodes 111 and 211 so as to allow the second connector 210 to be coupled to the first connector 110 in a state where left and right sides of the second connector 210 are reversed opposite to those of the first connector 110. Of course, the first and second guide members 119 and 219 may be asymmetrically arranged and may have asymmetric shapes in order to prevent the second connector 210 from coupling to the first connector 110 in a state where the left and right sides of the second connector 210 are reversed opposite to the first connector 110.

Next, coupling operations of the magnetic connection device according to the present exemplary embodiment.

Figure 4A:
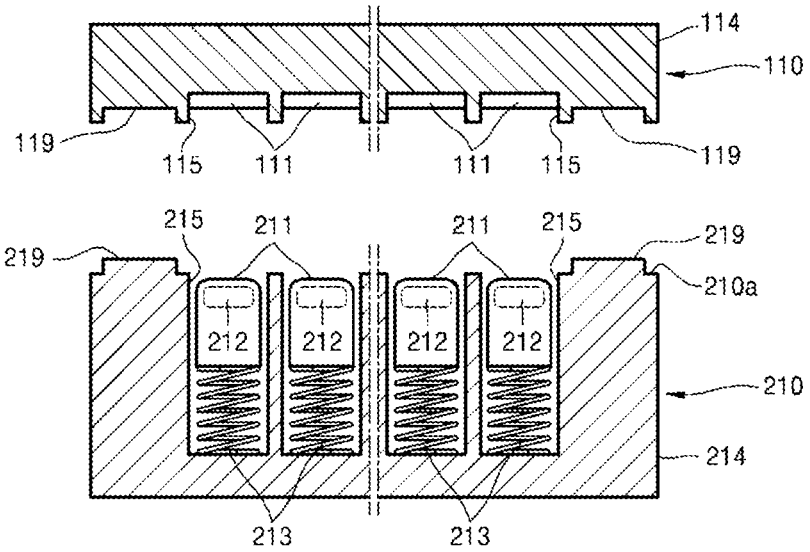
FIGS. 4A and 4B are diagrams showing coupling operations of the magnetic connection device shown in FIG. 1.
Figure 4B:
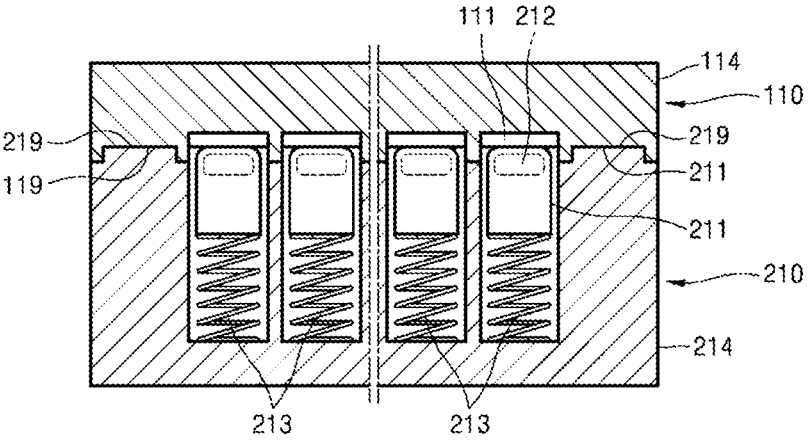

FIGS. 4A and 4B are diagrams showing coupling operations of the magnetic connection device of FIG. 1. Referring to FIG. 4A, since there is no magnetic attraction between the first electrodes 111 and the second electrodes 211 in a state where the first and second connectors 110 and 210 are apart from each other, the end of each second electrode 211 is located in the second housing 214 due to the tensile force of the elastic members 213.

When the first connector 110 and the second connector 210 approach each other, a distance between the first electrodes 111 and the second electrodes 211 is reduced, and accordingly, the magnetic attraction between the first and second electrodes 111 and 211 increases. When the first and second connectors 110 and 210 are sufficiently close to each other, the magnetic attraction applied between the first and second electrodes 111 and 211 is greater than the tensile force applied by the elastic members 213. Accordingly, as shown in FIG. 4B, the coupling locations of the first and second connectors 110 and 210 are guided by the first and second guide members 119 and 219, and then, the ends of the second electrodes 211 protrude out of the second housing 214 to be electrically connected to the first electrodes 111 of the first connector 110. Then, the coupling status between the first and second connectors 110 and 210 may be maintained due to the magnetic attraction between the first and second electrodes 111 and 211.

As described above, the first connector 110 and the second connector 210 form a magnetic connection device by being coupled to each other due to the magnetic attraction between the first electrodes 111 and the second electrodes 211. Such a magnetic connection device may prevent a coupling defect or a contact defect occurring due to mechanical and electrical characteristics of contact points in a conventional connection device. Moreover, since the second electrodes 211 are located inside the second housing 214 in a state where the second connector 210 is not connected to the first connector 110, possibility of damaging the second electrodes 211 may be reduced. In addition, since the second electrodes 211 are not exposed on an outer surface of the second connector 210 when the second connector 210 exists alone, the second connector 210 may be designed freely.

As described above, the arrangements and the magnetic arrangements of the first and second electrodes 111 and 211 may be symmetric with each other. In this case, even when the left and right sides of the second connector 210 are reversed opposite to those of the first connector 110, the first and second connectors 110 and 210 may be coupled to each other.

In the present exemplary embodiment, the first and second electrodes 111 and 211 are arranged in a row; however, the present inventive concept is not limited thereto. For example, the first and second electrodes 111 and 211 may be arranged in a plurality of rows, or in other symmetric patterns.

If necessary, the first and second electrodes 111 and 211 may be arranged asymmetrically with each other. In this case, the first and second connectors 110 and 210 may be coupled to each other only in a certain direction.

According to the present exemplary embodiment, the plurality of first electrodes 111 and the plurality of second electrodes 211 are disposed on the first connector 110 and the second connector 210; however, only one electrode may be respectively formed on the first connector 110 and the second connector 210.

Figure 5:
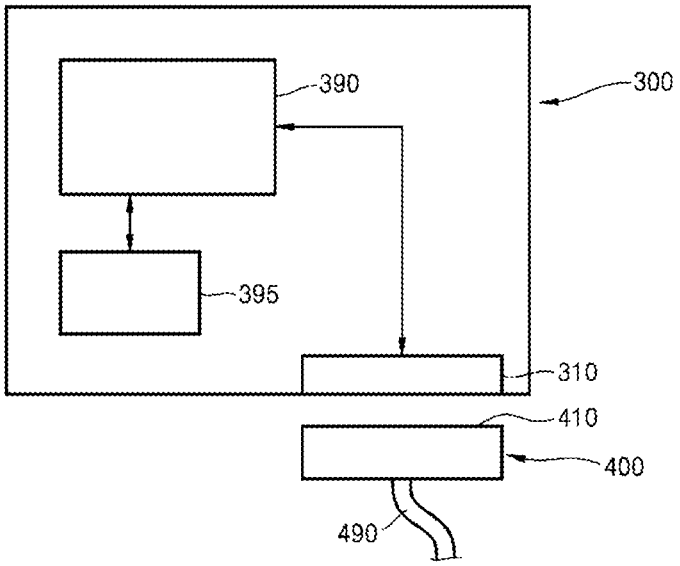
FIG. 5 is a diagram showing a magnetic connection device according to another exemplary embodiment.
Figure 6:
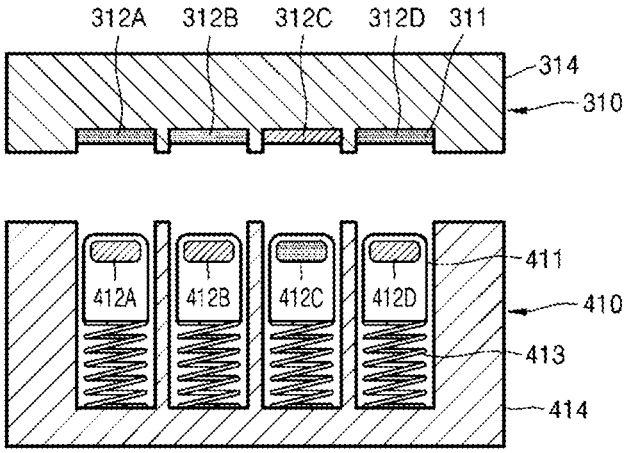
FIG. 6 is a transverse sectional view of an example of magnetic arrangement of a first connector and a second connector in the magnetic connection device of FIG. 5.

FIG. 5 is a diagram showing a magnetic connection device according to another exemplary embodiment, and FIG. 6 is a side sectional view showing an example of magnetic arrangements of a first connector 310 and a second connector 410 in the magnetic connection device of FIG. 5.

Referring to FIG. 5, the magnetic connection device includes the first connector 310 and the second connector 410. The first connector 310 may be provided, for example, in an electronic device 300, and the second connector 410 may be connected to another electronic device (not shown) via a cable 290. In addition, the electronic device 300 on which the first connector 310 is provided further includes a signal processor 390 performing signal processing according to a coupling direction of the second connector 410 to the first connector 310.

The signal processor 390 determines the coupling direction of the second connector 410 that is coupled to the first connector 310 based on a signal transferred through the first connector 310, with reference to a memory 395, and accordingly, rearranges signal transfer paths of first electrodes 311. As such, even if the coupling direction between the first connector 310 and the second connector 410 is changed and connecting pairs of the first electrodes 311 and second electrodes 411 are changed, normal electric connection may be performed.

Referring to FIG. 6, the first connector 310 includes a first housing 314 and a plurality of first electrodes 311 mounted on the first housing 314. The first electrodes 311 are formed of a conductive material such as metal, and include magnetic substances 312A, 312B, 312C, and 312D formed of ferromagnetic materials.

The second connector 420 includes a second housing 414, a plurality of second electrodes 411 mounted on the second housing 414, and elastic members 413 elastically supporting the second electrodes 411. The second electrodes 411 are formed of a conductive material such as metal, and may have magnetic substances 412A, 412C, 412C, and 412D formed of ferromagnetic materials. The first and second connectors 310 and 410 are substantially the same as the first and second connectors 110 and 210 described above, except for the magnetic arrangements of the first and second electrodes 311 and 411.

Figure 7:
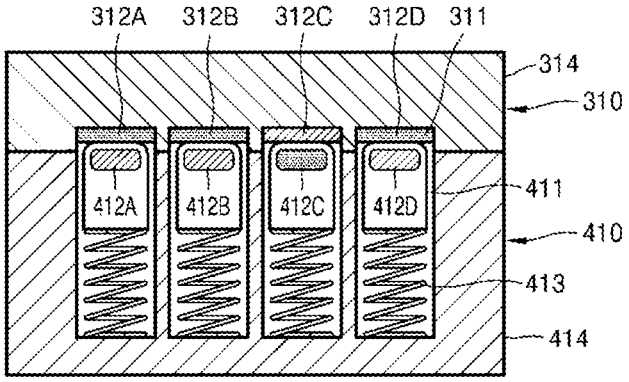
FIG. 7 is a side sectional view of a coupled state of the first and second connector shown in FIG. 6 at a first location.
Figure 8:
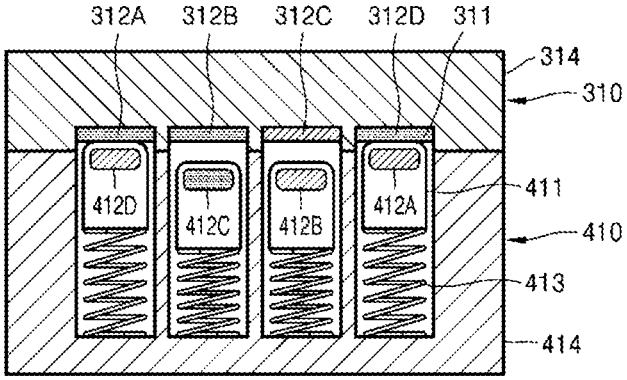
FIG. 8 is a side sectional view of a coupled state of the first and second connector shown in FIG. 6 at a second location.

FIG. 7 is a side sectional view showing the first and second connectors 310 and 410 coupled to each other at a first location, and FIG. 8 is a side sectional view showing the first and second connectors 310 and 410 coupled to each other at a second location.

The first and second electrodes 311 and 411 are magnetically arranged so that magnetic attraction may be applied to every corresponding pair of the first electrodes 311 and the second electrodes 411, when the first and second connectors 310 and 410 are connected to each other at the first location as shown in FIG. 7. That is, when the first and second connectors 310 and 410 are connected to each other at the first location, corresponding pairs of the first electrodes 311 of the first connector 310 and the second electrodes 411 of the second connector 410 have ferromagnetic characteristics of different polarities. For example, in FIG. 7, left two magnetic substances 312A and 312B of the first electrodes 311 may be N-poles and right two magnetic substances 312C and 312D of the first electrodes 311 may be S-poles, and then, left two magnetic substances 412A and 412B of the second electrodes 411 are S-poles and right two magnetic substances 412C and 412D of the second electrodes 411 are N-poles.

As shown in FIG. 8, the coupling direction of the second connector 410 to the first connector 310 is reversed, that is, the first connector 310 and the second connector 410 are connected to each other at the second location, an order of the second electrodes 411 corresponding to the first electrodes 311 is changed, and accordingly, the magnetic substances of the second electrodes 411 corresponding to the magnetic substances 312A, 312B, 312C, and 312D of the first electrodes 311 are arranged in an order of 412D, 412C, 412B, and 412A. However, as described above, when the magnetic substances 312A, 312B, 412C, and 412D have N-poles and the magnetic substances 312C, 312D, 412A, and 412B are S-poles, the leftmost and rightmost magnetic substances 312A and 312D of the first electrodes 311 and the corresponding leftmost and rightmost magnetic substances 412D and 412A of the second electrodes 411 have opposite polarities, and thus, the magnetic attraction is applied to the leftmost and rightmost pairs. However, the magnetic substances 312B and 312C of the first electrodes 311 at a center portion and the corresponding magnetic substances 412C and 412D of the second electrodes 411 have the same polarities, and thus, magnetic repulsive force is applied between the above pairs. Accordingly, the two electrode pairs, that is, the leftmost and the rightmost pairs of the first and second electrodes 311 and 411, are electrically connected to each other; however, the two electrode pairs at the center portion of the first and second electrodes 311 and 411 are not connected to each other. On the other hand, even when the coupling direction of the second connector 410 to the first connector 310 is reversed, the magnetic attraction applied between the two leftmost and rightmost pairs of the first and second electrodes 311 and 411 may be set to be greater than the magnetic repulsive force applied between the two central pairs of the first and second electrodes 311 and 411, or the magnetic attraction generated by other electrode pairs (not shown) may be applied additionally, and then, the first and second connectors 310 and 410 may be electrically connected to each other.

Otherwise, the electric connection between some of the electrode pairs may vary depending on the coupling direction between the first connector 310 and the second connector 410. Referring back to FIG. 5, the signal processor 390 may determine the coupling direction between the first and second connectors 310 and 410 according to whether electric signals are transferred from some of the first electrodes 311 when the first and second connectors 310 and 410 are coupled to each other. That is, the electrode, electric connection of which may vary depending on the coupling location of the first and second connectors 310 and 410, may serve as a detection sensor for detecting the coupling direction between the first and second connectors 310 and 410.

For example, in the magnetic arrangements shown in FIGS. 7 and 8, it may be determined whether the coupling direction between the first and second connectors 310 and 410 is the first location or the second location according to whether the electric signals are transferred from the two central electrodes among the first electrodes 311. That is, when the electric signals are transferred from the two central electrodes among the first electrodes 311, the signal processor 390 determines that the coupling direction between the first connector 310 and the second connector 410 is the first location, and maintains signal transfer paths of the left and right electrodes from among the first electrodes 311. Also, when the electric signals do not transfer through the two central electrodes among the first electrodes 311, the signal processor 190 determines that the coupling direction between the first and second connectors 310 and 410 is the second location, and exchanges the signal transfer paths of the left and right sides of the first electrodes 311 so that the signal transfer paths may be the same as those of a case where the first and second connectors 310 and 410 are coupled to each other in the first location.

According to the present exemplary embodiment, the coupling location of the first and second connectors 310 and 410 is corrected by the signal processor 390, by using the fact that the electric connections between some of the electrodes may vary according to the coupling location between the first and second connectors 310 and 410. However, the present inventive concept is not limited thereto. The magnetic arrangement of the second electrodes 411 of the second connector 410 is changed with respect to the magnetic arrangement of the first electrodes 311 of the first connector 310, the electric connections between the first and second electrodes 311 and 411 may be changed. Therefore, if the second connector 410 having the second electrodes 411, the magnetic arrangement of which is distinctive arrangement depending on each electronic device, is connected to the first connector 310, the signal processor 390 may identify the electronic device connected to the second connector 410 based on whether certain electrodes of the first and second connectors 310 and 410 are electrically connected to each other.

Figure 9:
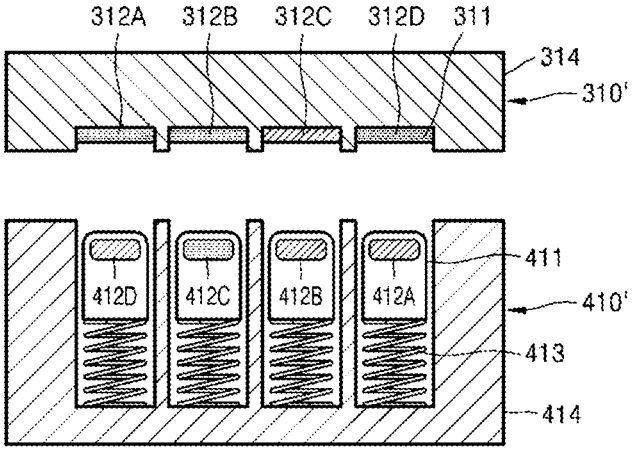
FIG. 9 is a side sectional view showing another example of magnetic arrangements of the first and second connectors shown in FIG. 5.
Figure 10:
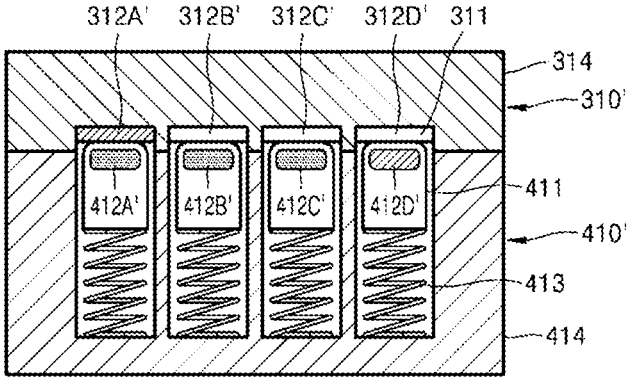
FIG. 10 is a side sectional view of a coupled state of the first and second connector shown in FIG. 9 at a first location.
Figure 11:
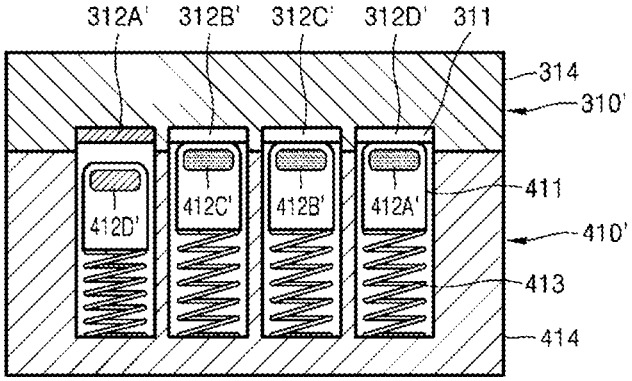
FIG. 11 is a side sectional view of a coupled state of the first and second connector shown in FIG. 9 at a second location.

FIG. 9 is a side sectional view showing another example of the magnetic arrangements of the first and second connectors 310 and 420 in the magnetic connection device of FIG. 5, FIG. 10 is a side sectional view showing a first connector 310' and a second connector 410' coupled to each other at a first location according to another exemplary embodiment, and FIG. 11 is a side sectional view showing the first connector 310' and the second connector 410' coupled to each other at a second location.

Referring to FIG. 9, the first electrodes 311 of the first connector 310' are formed of a conductive material such as metal. Some of the first electrodes 311 have magnetic substance 312A' formed of a ferromagnetic material, and the other of the first electrodes 311 have magnetic substances 312B', 312C', and 312D' formed of a paramagnetic material. The second electrodes 411 of the second connector 410' are formed of a conductive material such as metal. Some of the second electrodes have magnetic substances 412A', 412B', and 412C' formed of a paramagnetic material, and the other of the second electrodes 411 have a magnetic substance 412D' formed of a ferromagnetic material. The first and second electrodes 311 and 411 are substantially the same as those of the first and second connectors 310 and 410 described with reference to FIGS. 6 through 8, except for the magnetic arrangements of the first and second electrodes 311 and 411. In the exemplary embodiment shown in FIGS. 6 through 8, the first and second electrodes 311 and 411 all have the ferromagnetic properties; however, in the present exemplary embodiment, the magnetic arrangements of the first and second electrodes 311 and 411 are combination of the ferromagnetic property and the paramagnetic property.

When the first connector 310' and the second connector 410' are connected to each other at a first location, the first and second electrodes 311 and 411 are magnetically arranged so that some of corresponding pairs of the first and second electrodes 311 and 411 have the ferromagnetic properties of opposite polarities and the other of the corresponding pairs have the paramagnetic properties at a side and the ferromagnetic properties at the other side. That is, when the first and second connectors 310' and 410' are connected to each other at the first location as shown in FIG. 10, the magnetic attraction is applied to all of the corresponding pairs of the first and second electrodes 311 and 411. For example, in FIG. 10, the first electrodes 311 may have the magnetic substances, in which one left magnetic substance 312A' has an N-polarity and remaining three magnetic substances 312B', 312C', and 312D' are paramagnetic with no polarity, and the second electrodes 411 may have the magnetic substances, in which left three magnetic substances 412A', 412B', and 412C' have S-polarities and remaining one magnetic substance 412D' may have an N-polarity.

As shown in FIG. 11, if a coupling direction of the second connector 410' to the first connector 310' is changed, that is, the first and second connectors 310' and 410' are connected to each other at a second location, an order of the second electrodes 411 corresponding to the first electrodes 311 is changed, and accordingly, the magnetic substances of the second electrodes 411 corresponding to the magnetic substances 312A', 312B', 312C', and 312D' of the first electrodes 311 are arranged in an order of 412D', 412C', 412B', and 412A'. However, since one magnetic substance 312A' has N-polarity and remaining three magnetic substances 312B', 312C', and 312D' have paramagnetic properties with no polarity among the first electrodes 311 and three magnetic substances 412A', 412B', and 412C' have S-polarity and one remaining magnetic substance 412D' has the N-polarity among the second electrodes 411, the leftmost magnetic substance 312A' of the first electrodes 311 and the corresponding leftmost magnetic substance 412D' of the second electrodes 411 have the same polarities, that is, S-polarity. Thus, the magnetic repulsive force is applied between the leftmost pair so as not to be electrically connected to each other. In addition, the magnetic attraction is applied to remaining corresponding pairs of the first and second electrodes 311 and 411, wherein each of the pairs has paramagnetic-ferromagnetic properties, and thus, the remaining pairs are electrically connected to each other.

As described above, since the electric connections between some of the electrodes may vary according to the coupling location between the first connector 310' and the second connector 410', the signal processor (390 of FIG. 5) may determine the coupling direction between the first connector 310' and the second connector 410' according to whether the electric signals are transferred through some of the first electrodes 311 of the first connector 310'.

Figure 12:
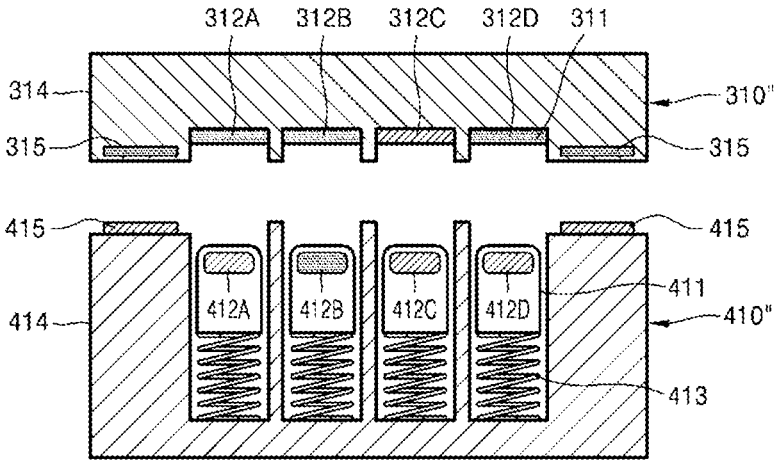
FIG. 12 is a diagram showing a first connector and a second connector in a magnetic connection device according to another exemplary embodiment.
Figure 13:
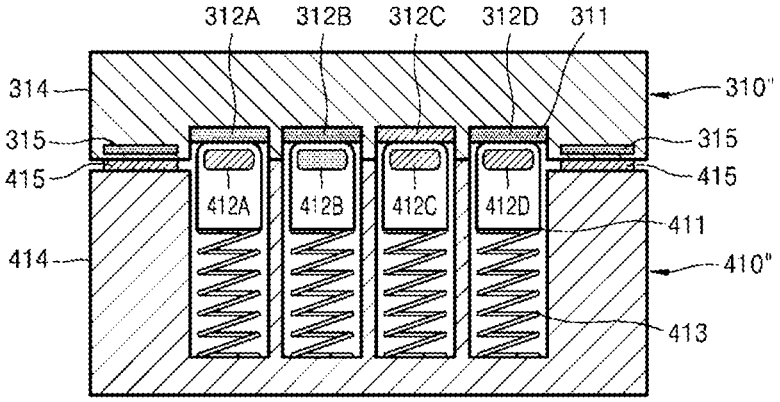
FIG. 13 is a side sectional view of a coupled state of the first and second connector shown in FIG. 12 at a first location.
Figure 14:
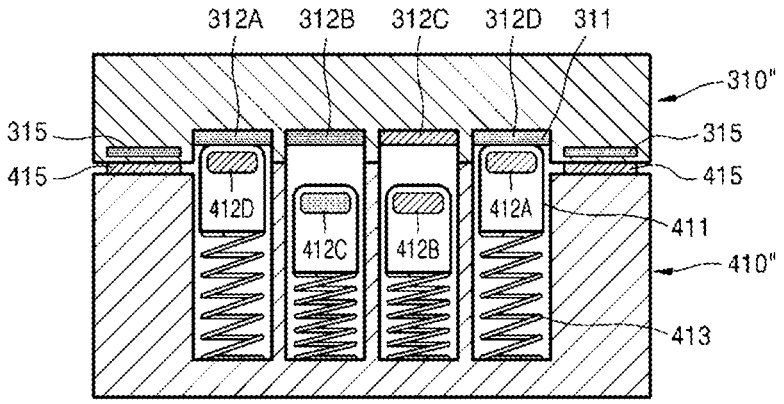
FIG. 14 is a side sectional view of a coupled state of the first and second connector shown in FIG. 12 at a second location.

FIG. 12 is a diagram showing a first connector 310" and a second connector 410" of a magnetic connection device according to another exemplary embodiment, FIG. 13 is a side sectional view showing the first and second connectors 310" and 410" of FIG. 12 coupled to each other at a first location, and FIG. 14 is a side sectional view of the first and second connectors 310" and 410" of FIG. 12 coupled to each other at a second location.

The first connector 310" further includes a first magnetic coupling portion 315 and the second connector 410" further includes a second magnetic coupling portion 415. The magnetic connection device of the present exemplary embodiment is substantially the same as the magnetic connection device described with reference to FIGS. 6 through 8, except for that the first and second connectors 310" and 410" further include the first and second coupling portions 315 and 415, respectively.

One of the first magnetic coupling portion 315 and the second magnetic coupling portion 415 is formed of a ferromagnetic material, and the other may be formed of a paramagnetic material. In such above magnetic arrangement, if the first and second connectors 310" and 410" are coupled to each other at the first location as shown in FIG. 13 or at the second location as shown in FIG. 14, magnetic attraction may be always applied between the ferromagnetic-paramagnetic pairs. The first and second magnetic coupling portions 315 and 415 are disposed on locations that face each other when the first and second connectors 310" and 410" are coupled to each other, so as to reinforce the magnetic coupling between the first and second electrodes 311 and 411. In particular, as shown in FIG. 14, if the magnetic repulsive force is generated in some pairs of the first and second electrodes 311 and 411 and the magnetic coupling force between the first and second electrodes 311 and 411 is weakened, the magnetic coupling between the first and second connectors 310" and 410" may be reinforced by the first and second magnetic coupling portions 315 and 415.

In the present exemplary embodiment, the first and second magnetic coupling portions 315 and 415 have a combination of the ferromagnetic-paramagnetic properties; however, the first and second magnetic coupling portions 315 and 415 may have ferromagnetic properties of opposite polarities.

Figure 15:
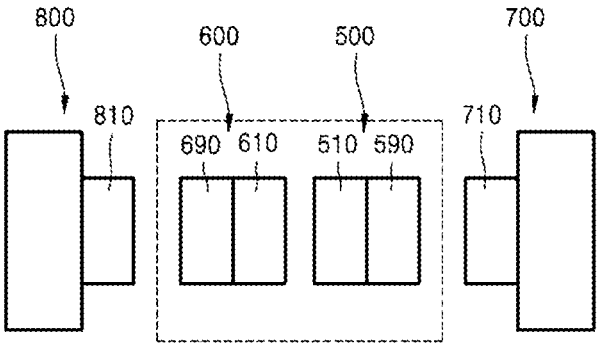
FIG. 15 is a conceptual view of a magnetic connection device according to another exemplary embodiment.
Figure 16:
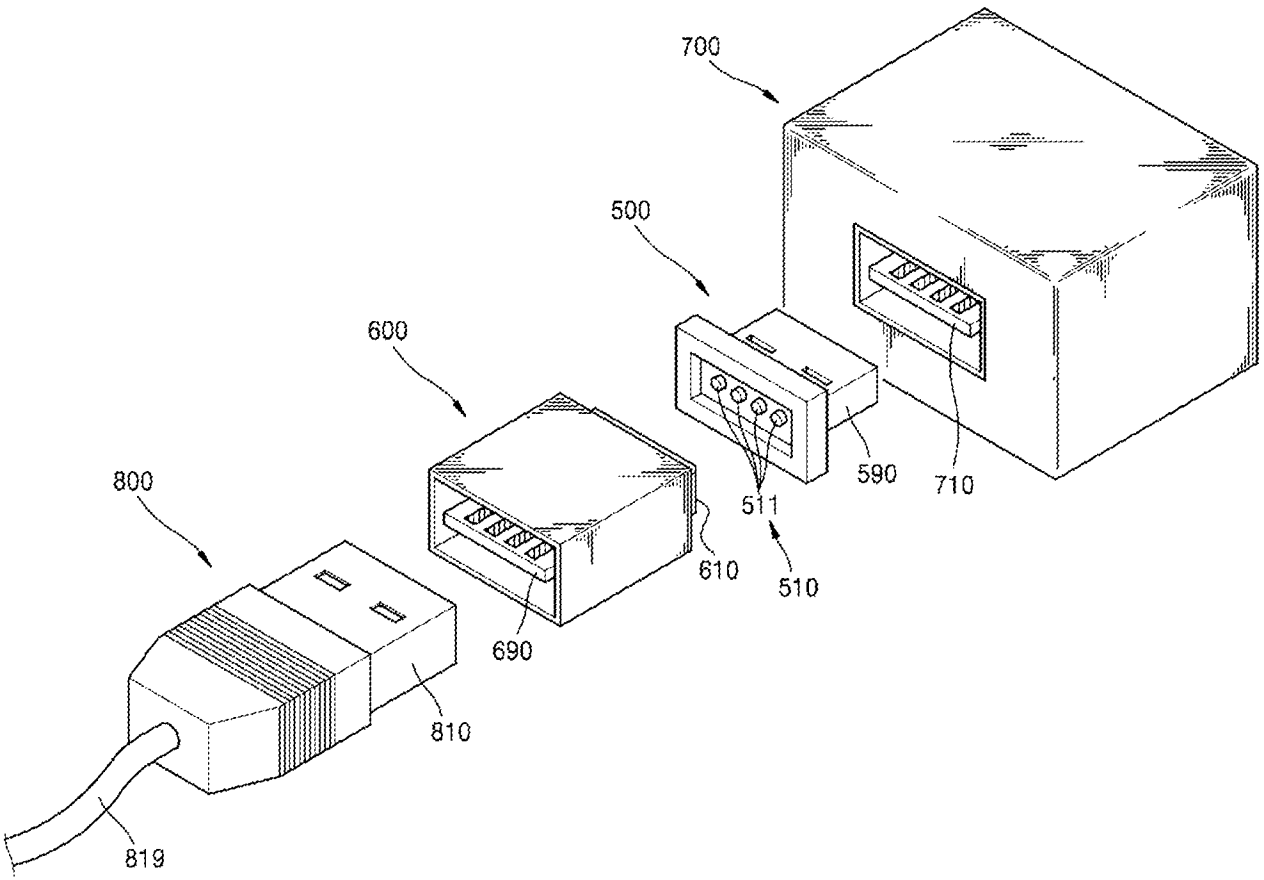
FIG. 16 is a diagram showing an example of the magnetic connection device shown in FIG. 15.

FIG. 15 is a conceptual view of a magnetic connection device according to another exemplary embodiment, and FIG. 16 is a diagram showing the magnetic connection device of FIG. 15 in more detail.

Referring to FIGS. 15 and 16, the magnetic connection device of the present exemplary embodiment includes a first connector 500 and a second connector 600.

The first connector 500 includes a first terminal 510 connected to the second connector 600, and a second terminal 590 connected to a third connector 710 of an external electronic device 700. Likewise, the second connector 600 includes a first terminal 610 connected to the first connector 500, and a second terminal 690 connected to a fourth connector 810 of an external electronic device 800. FIG. 16 shows that the third connector 710 is built in the electronic device 700, and the fourth connector 810 is connected to the external electronic device 800 (refer to FIG. 15) via a cable 819. However, the present inventive concept is not limited thereto.

The first terminal 510 of the first connector 500 and the first terminal 610 of the second connector 600 are magnetic connector terminals, and may be respectively the first and second connectors 110, 210, 310, 310', 310", 410, 410', and 410" described in the previous exemplary embodiments.

The second terminal 590 of the first connector 500 may have an interfacial structure that may be coupled to the external third connector 710 that is desired to be connected. For example, the second terminal 590 of the first connector 500 may have an electric interface of a digital type or an analog type. Otherwise, the second terminal 590 of the first connector 500 may have an optical interface structure to provide an optical connection method. The second terminal 590 of the first connector 500 and a terminal of the third connector may be well known connector terminals. For example, the second terminal 590 of the first connector 500 and the third connector 710 may be connector terminals that satisfy USB (Universal Serial Bus) standard, IEEE 1394 standard, D-SUB standard, DIV (Digital Video Interface) standard, HDMI (High Definition Multimedia Interface) standard, or other well known standards. Otherwise, the third connector 710 may have a specified interface structure that is not standardized for security or device identification, and in this case, the second terminal 590 of the first connector 500 may have a specified interface structure corresponding to the third connector 710. Moreover, the second terminal 590 of the first connector 500 may be a universal connector terminal that may satisfy two different standards at the same time.

The second terminal 690 of the second connector 600 may have an interface structure that may be coupled to an external fourth connector 810 that is desired to be connected. For example, the second terminal 690 of the second connector 600 may be a well known connector terminal as described above, or may have a specified interface structure that is not standardized. Also, the second terminal 690 of the first connector 600 may be a universal connector terminal that may satisfy two different standards at the same time. The second terminal 690 of the second connector 600 and the second terminal 590 of the first connector 500 may be respectively a female connector terminal and a male connector terminal of the same type. Otherwise, the second terminal 690 of the second connector 600 may be a connector terminal that is different kind from that of the second terminal 590 of the first connector 500.

The first connector 500 and the second connector 600 may function as connector converters that respectively convert the third connector 710 and the fourth connector 810 into magnetic connector terminals. For example, as shown in FIG. 16, if the second terminal 590 of the first connector 500 is a USB male terminal and the second terminal 690 of the second connector 600 is a USB female terminal, the first and second connectors 500 and 600 are USB-magnetic connector converters that convert a USB connector into a magnetic connector.

Such a combination of the first and second connectors 500 and 600 may provide a security function or an identification function. As described above, when the magnetic arrangements of electrodes in the first and second connectors 500 and 600 are changed, the electric connection between the first and second connectors 500 and 600 is changed, and thus, the first connector 500 having the first electrodes 511 that are magnetically arranged in a certain order may be only connected to the second connector 600. In this case, the combination of the first and second connectors 500 and 600 may serve as a security connector. Also, if the magnetic arrangement of the first electrodes 511 in the first connector 500 may vary depending on the electronic device 700, the electronic device 700 connected to the first connector 510 may be identified according to whether certain electrodes are electrically connected or not when the first and second connector 510 and 610 are connected to each other.

According to the magnetic connection device of one or more exemplary embodiments, the electrodes do not protrude in a state where the male connector and the female connector are not coupled to each other so that damage of the electrodes may be prevented and a terminal contact surface may be simplified. Also, according to the magnetic connection device of one or more exemplary embodiments, since the connectors are coupled to each other by the magnetic attraction, not by forced pushing of the connector by the user, durability and reliability of the device may be improved. Also, variation in the contact force according to the users may be reduced, and the connectors may be easily attached to/detached from each other with relatively weak force.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

What is claimed is:

1. A magnetic connection device comprising:

a first connector comprising a first housing and a plurality of first electrodes mounted on the first housing in a state of being partially exposed and having magnetic substances; and a second connector comprising a second housing, a plurality of second electrodes mounted on the second housing and having magnetic substances, and elastic members for elastically supporting the plurality of second electrodes, wherein an end portion of each of the plurality of second electrodes is located in the second housing due to an elasticity of the elastic members in a state where a magnetic attraction is not applied from the plurality of first electrodes, and protrudes out of the second housing to be electrically connected to each of the plurality of first electrodes in corresponding pairs when there is the magnetic attraction applied from each of the plurality of first electrodes, and wherein a tensile force of each of the elastic members is less than the magnetic attraction applied from each of the plurality of second electrodes.

2. The magnetic connection device of claim 1, wherein the first connector and the second connector are configured to be coupled to each other due to the magnetic attraction between the first electrodes and the second electrodes.

3. The magnetic connection device of claim 1, wherein the first connector and the second connector further comprise a first magnetic coupling portion and a second magnetic coupling portion, respectively.

4. The magnetic connection device of claim 1, wherein partially exposed parts of the first electrodes are concaved from an outer surface of the first housing.

5. The magnetic connection device of claim 1, wherein the first connector and the second connector respectively comprise a first guide member and a second guide member having complementary shapes configured to guide coupling positions of the first and second connectors.

6. The magnetic connection device of claim 1, wherein arrangements of the plurality of first electrodes and the plurality of second electrodes are symmetric with each other with respect to at least two positions where the first connector and the second connector are configured to be coupled to each other.

7. The magnetic connection device of claim 1, wherein the plurality of first electrodes are arranged in a first magnetic arrangement and the plurality of second electrodes are arranged in a second magnetic arrangement, and the first magnetic arrangement and the second magnetic arrangement are arranged in arrangement orders by which all of the plurality of first electrodes and all of the plurality of second electrodes are configured to be electrically connected to each other in corresponding pairs due to magnetic attraction when the first connector and the second connector are coupled to each other at a first position.

8. The magnetic connection device of claim 7, wherein magnetic repulsive force is applied or magnetic attraction is not applied to at least one corresponding pair of the plurality of first electrodes and the plurality of second electrodes such that the at least one corresponding pair of the plurality of first electrodes and the plurality of second electrodes is configured to not be electrically connected to each other when the first connector and the second connector are coupled to each other at a second position that is different from the first position.

9. The magnetic connection device of claim 7, wherein the plurality of first electrodes and the plurality of second electrodes are configured to be electrically connected to each other in corresponding pairs due to the magnetic attraction even the first connector and the second connector are coupled to each other at a second position that is different from the first position.

10. The magnetic connection device of claim 1, wherein when the first connector and the second connector are coupled to each other at a first position, corresponding pairs of the plurality of first electrodes and the plurality of second electrodes are pairs of a ferromagnetic property and a paramagnetic property, or pairs of ferromagnetic properties of opposite polarities.

11. The magnetic connection device of claim 10, wherein when the first connector and the second connector are coupled to each other at a second position that is different from the first position, at least one of the corresponding pairs of the plurality of first electrodes and the plurality of second electrodes has paramagnetic properties, or ferromagnetic properties of the same polarity.

12. The magnetic connection device of claim 10, wherein when the first connector and the second connector are coupled to each other at a second position that is different from the first position, corresponding pairs of the plurality of first electrodes and the plurality of second electrodes are pairs of a ferromagnetic property and a paramagnetic property, or pairs of ferromagnetic properties of opposite polarities.

13. The magnetic connection device of claim 1, further comprising a signal processor configured to readjust signal transfer paths of the plurality of first electrodes in the first connector according to a coupling position between the first connector and the second connector.

14. The magnetic connection device of claim 13, wherein the signal processor is further configured to determine the coupling position between the first connector and the second connector according to whether at least one of the corresponding pairs of the plurality of first electrodes and the plurality of second electrodes is electrically connected or not.

15. The magnetic connection device of claim 14, wherein the plurality of first electrodes are arranged in a first magnetic arrangement and the plurality of second electrodes are arranged in a second magnetic arrangement, and the first magnetic arrangement and the second magnetic arrangement allow the plurality of first electrodes and the plurality of second electrodes to be electrically connected in corresponding pairs to each other due to the magnetic attraction when the first connector and the second connector are coupled to each other at a first position, and allow at least one of corresponding pairs of the plurality of first electrodes and the plurality of second electrodes to not be electrically connected because the magnetic repulsive force is applied to the pair or the magnetic attraction is not applied to the pair when the first connector and the second connector are coupled to each other at a second position that is different from the first position.

16. The magnetic connection device of claim 1, wherein the first connector comprises a first terminal, in which the plurality of first electrodes are located, configured to contact the second connector, and a second terminal attachable to a third connector, and the second connector comprises a first terminal, in which the plurality of second electrodes are located, configured to contact the first connector, and a second terminal attachable to a fourth connector.

17. The magnetic connection device of claim 16, wherein the second terminal of the first connector and the second terminal of the second connector are respectively a female connector terminal and a male connector terminal of the same type.

18. The magnetic connection device of claim 16, wherein the second terminal of the first connector and the second terminal of the second connector are connector terminals of different types.

19. The magnetic connection device of claim 16, wherein the second terminal of the first connector and the second terminal of the second connector satisfy at least one of USB (Universal Serial Bus) standard, IEEE 1394 standard, D-SUB standard, DIV (Digital Video Interface) standard, and HDMI (High Definition Multimedia Interface) standard.

20. A connector configured to be connected to another connector including a plurality of other electrodes having magnetic properties, the connector comprising:

a housing;

a plurality of electrodes mounted in the housing and having magnetic properties;

an elastic member elastically supporting the plurality of electrodes;

wherein an end portion of each of the plurality of electrodes is located in the housing due to an elasticity of the elastic member in a state where a magnetic attraction is not applied, and protrudes out of the housing to be electrically connected to each of the plurality of other electrodes in corresponding pairs when there is the magnetic attraction applied from each of the plurality of other electrodes, and wherein a tensile force of each of the elastic members is less than the magnetic attraction applied from each of the plurality of other electrodes.

* * * * *